US008092270B2

(12) United States Patent
Sterndale et al.

(10) Patent No.: US 8,092,270 B2
(45) Date of Patent: Jan. 10, 2012

(54) TUBULATION-FREE GAS FILLED ELECTRODE OR LAMP

(75) Inventors: Robert Sterndale, Madbury, NH (US); Kevin Como, Chichester, NH (US)

(73) Assignee: Powerspan Corp., Portsmouth, NH (US)

( * ) Notice: Subject to any disclaimer, the term of this patent is extended or adjusted under 35 U.S.C. 154(b) by 132 days.

(21) Appl. No.: 12/418,885

(22) Filed: Apr. 6, 2009

(65) Prior Publication Data

US 2009/0253335 A1 Oct. 8, 2009

Related U.S. Application Data

(60) Provisional application No. 61/042,534, filed on Apr. 4, 2008.

(51) Int. Cl.
*H01J 9/38* (2006.01)
*H01J 9/24* (2006.01)

(52) U.S. Cl. ..... 445/38; 445/23

(58) Field of Classification Search ..... 445/38; 313/627–643
See application file for complete search history.

(56) References Cited

U.S. PATENT DOCUMENTS 6,181,065 B1 * 1/2001 Huettinger et al. ..... 313/625
2003/0222581 A1 * 12/2003 Niimi ..... 313/623
* cited by examiner

*Primary Examiner* — Toan Ton
*Assistant Examiner* — Zachary Snyder
(74) *Attorney, Agent, or Firm* — Grossman Tucker Perreault & Pfleger PLLC

(57) ABSTRACT

A method of making a tubulation-free gas filled electrode or lamp having the steps of providing a glass or quartz tube having a first end and a second end opposite the first end; inserting a cathode into the first end; crimping the first end thereby securing the cathode and making the first end airtight; securing a solid plug inside the tube second end but leaving a gap between the plug and tube through which gas can pass; evacuating air from inside the tube by drawing it through the second end past the plug; charging the tube with a gas; and sealing the plug gap to make the second end airtight.

9 Claims, 5 Drawing Sheets

TUBULATION-FREE GAS FILLED ELECTRODE OR LAMP

BACKGROUND

1. Field of the Invention

The invention relates to gas filled electrodes and lamps.

2. Description of the Related Art

Gas filled electrodes ("GFEs") are used in many applications, including but not limited to ozone generators and non-thermal dielectric barrier discharge reactors. GFE designs are derived from common gas filled lamp designs with which they share many features. One of the undesirable features of GFEs is the tubulation common to all existing GFE designs and to gas discharge lamps in general.

The tubulation feature results from the need to evacuate air from the lamp or GFE interior volume, and then charge that volume with the desired gas or gases. This evacuation and charging is accomplished by attaching a small tube to an opening in the lamp or GFE wall. Air is removed and gas inserted through the small tube, which is subsequently fused shut and broken or twisted off while softened by heating.

The tubulation produces a small protrusion from the GFE wall, which is more fragile than the balance of the GFE wall. Designing a reliable GFE necessitates protecting that weakness from damage. Accomplishing that protection leads to dimensional and manufacturing complications in the design.

Even with compensating design measures, the underlying weakness remains. What is needed, therefore, is a GFE or lamp and method of evacuating air and inserting desired gas that does not produce a tubulation.

SUMMARY

The invention is a GFE or lamp and method of evacuating air and inserting a desired gas that does not produce a tubulation. The invention is a method comprising the steps of providing a glass or quartz tube having a first end and a second end opposite the first end; inserting a cathode into the first end; crimping the first end thereby securing the cathode and making the first end airtight; securing a solid plug inside the tube second end but leaving a gap between the plug and tube through which gas can pass; evacuating air from inside the tube by drawing it through the second end past the plug; charging the tube with a gas; and sealing the plug gap to make the second end airtight. These and other features, aspects, and advantages of the present invention will become better understood with regard to the following description, claims, and accompanying drawings.

DRAWINGS

DESCRIPTION

GFE

Figure 2:
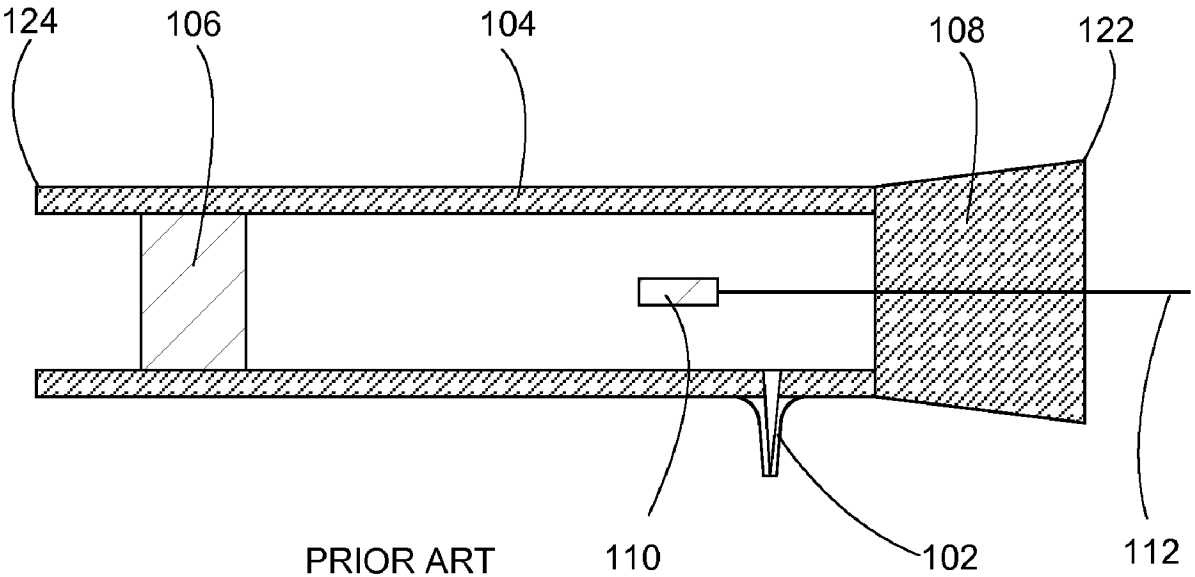
FIG. 2 is a left side sectional view of the prior art GFE of FIG. 1.
Figure 1:
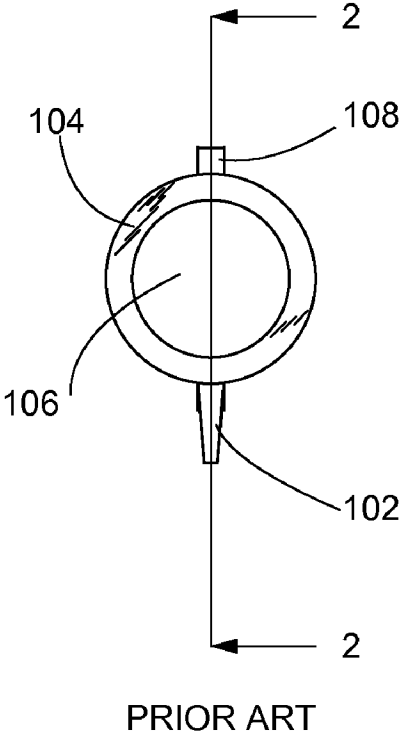
FIG. 1 is a front elevation of a GFE of the prior art.

The invention is a GFE or lamp and method of evacuating air and inserting a desired gas that does not produce a tubulation. Turning to FIGS. 1 and 2, the prior art GFE starts as a glass or quartz tube 104. In the drawings, the tube sections are hatched to show they are transparent. The tube has a first end 122 and a second end 124 opposite the first end 122.

To make a GFE, a cathode 110 is inserted in the first end. The first end 122 is heated and crimped shut, sealing to the cathode lead wire 112, which emerges from the first end 122 of the tube 104.

Some GFE applications require a length of non-conductive material at the second end 124 of the tube 104 opposite the cathode 110. This non-conductive region is created by installing a solid plug 106 in the tube where the conductive region should end. The plug 106 is fused to the tube 104 wall to seal the volume that will be evacuated and charged with conductive gas.

As shown in FIGS. 1 and 2, conventional prior art construction requires connecting a small tube 102 to the sealed volume somewhere along the wall of the sealed volume. This tube 102 becomes the passage for air evacuation and gas charging. After the evacuating and charging operation, the tubulation tube 102 is heated, fused shut, and broken off leaving a small tip of fragile quartz or glass.

Figure 4:
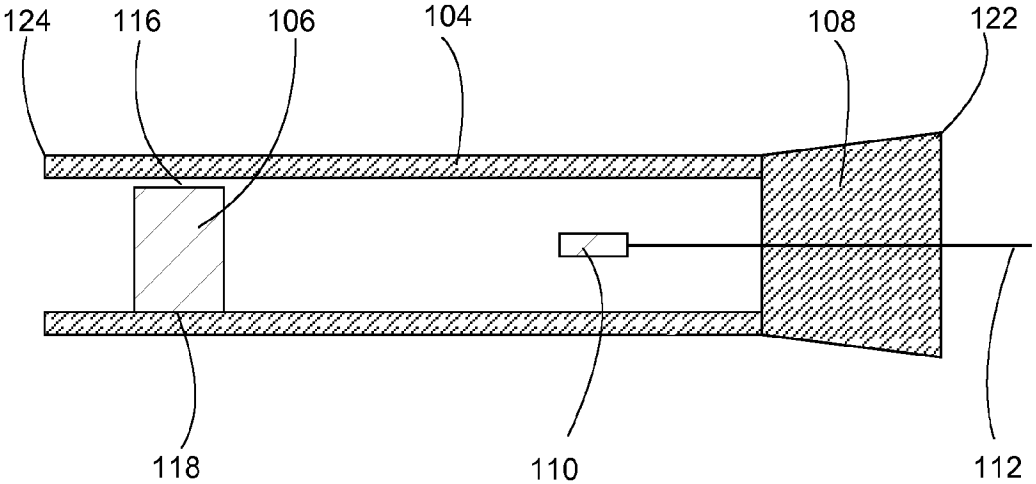
FIG. 4 is a left side sectional view of the GFE of FIG. 3.
Figure 3:
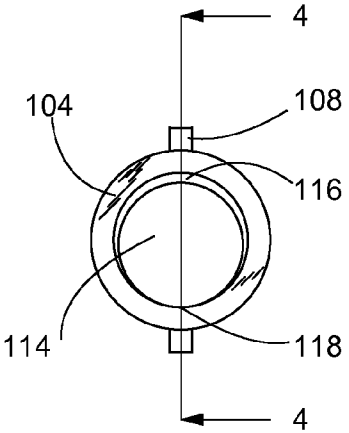
FIG. 3 is a front elevation of a GFE according to the present invention before sealing.

An improved GFE and method of making it are shown in FIGS. 3 and 4. First, a glass or quartz tube 104 is provided. The tube 104 has a first end 122 and a second end 124 opposite the first end 122. Insert a cathode 110 into the first end 122. Crimp the first end shut forming a crimp 108 and thereby securing the cathode and making the first end 122 airtight.

Install a solid plug 106 inside the tube 104 second end 124, but leave a gap 116 between the plug 106 and tube 104 through which gas can pass. The plug 106 is anchored to the tube wall at area 118.

Figure 5:
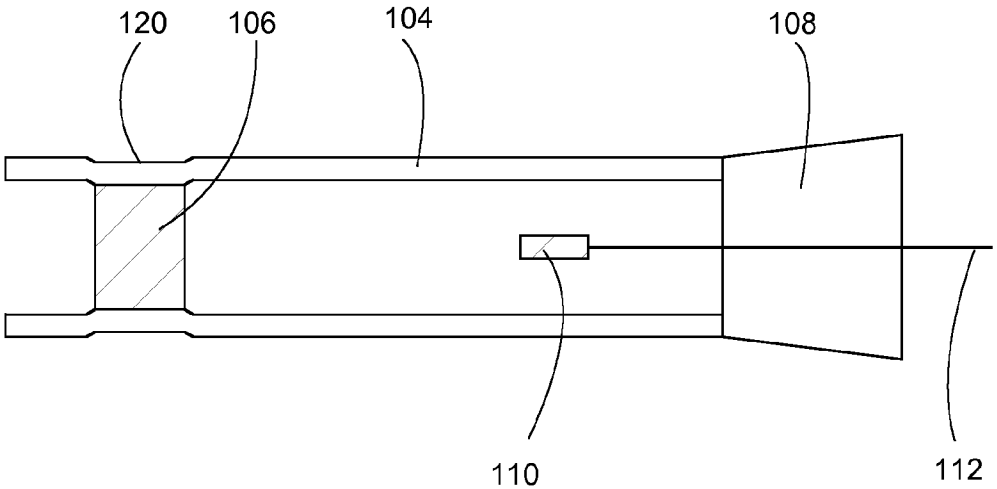
FIG. 5 is a GFE according to the present invention after sealing.

Evacuate air from inside the tube by connecting a vacuum means to the second end 124 and drawing air through the second end 124 and past the plug 106. Then charge the tube from the same opening with a desired gas or gases, letting the vacuum draw the gas inside. While the open second end 124 is still under a gas charge, seal the plug 106 to the tube by heating the area around the plug 120 in FIG. 5. Please note that the tube 104 is not hatched in FIG. 5 to improve clarity. This closes the plug gap 116 to make the second end 124 airtight and isolating the sealed volume. Vent the open end to the atmosphere, thereby restoring its non-conductive property. The resulting GFE has all the desirable properties of the GFE of FIGS. 1 and 2 without the undesirable tubulation tip 102.

Lamp

Figure 6:
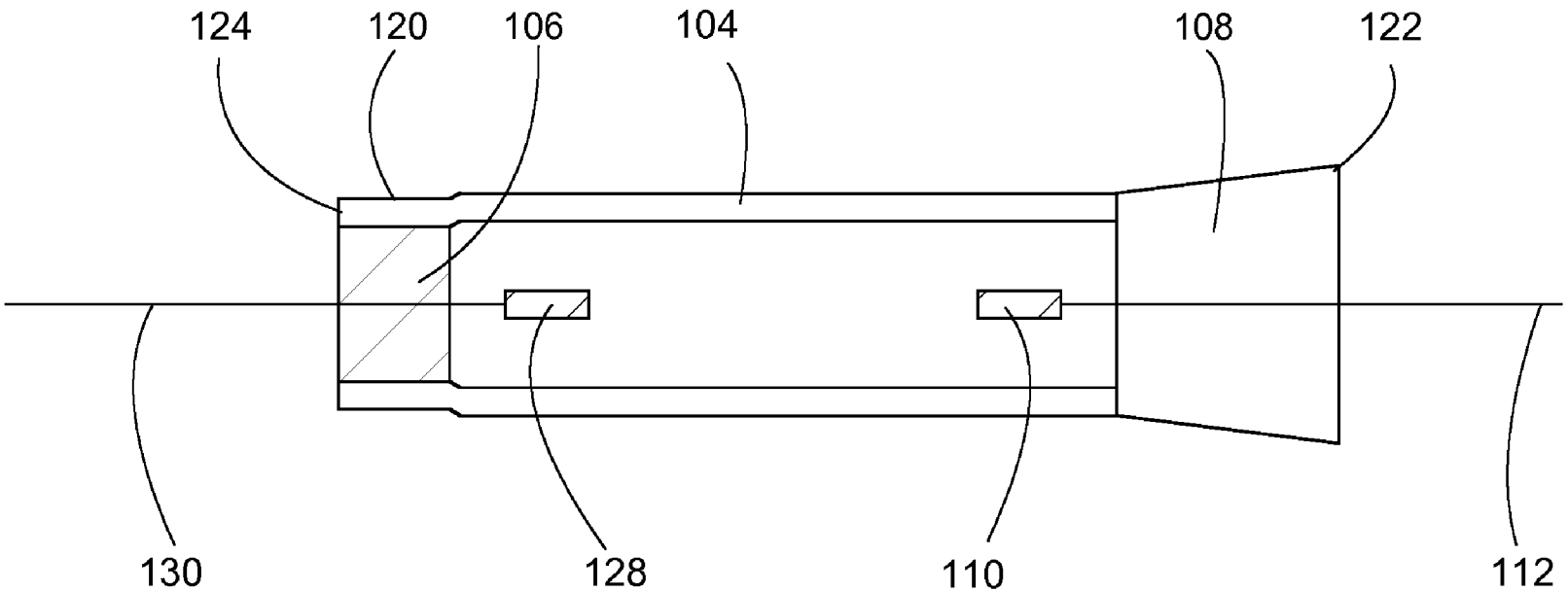
FIG. 6 is a tubulation-free lamp according to the present invention.

Conventional discharge lamps differ from GFE design in that they have a cathode at both ends. FIG. 6 shows a lamp with tubulation free construction similar to the GFE of present invention. A second cathode 128 with second wire 130 is pressed into plug 106. Install plug 106 (with cathode and wire) at the second end of the tube 124. Evacuate air and charge the tube with gas as for the GFE. Seal plug 106 to the wall by heating. Trim the tube length as required to produce the desired end configuration (eliminating the non-conductive region described as part of the GFE design). The resulting assembly now resembles a typical gas-filled tubular lamp with an electrode at each end but with no tubulation.

Figure 7:
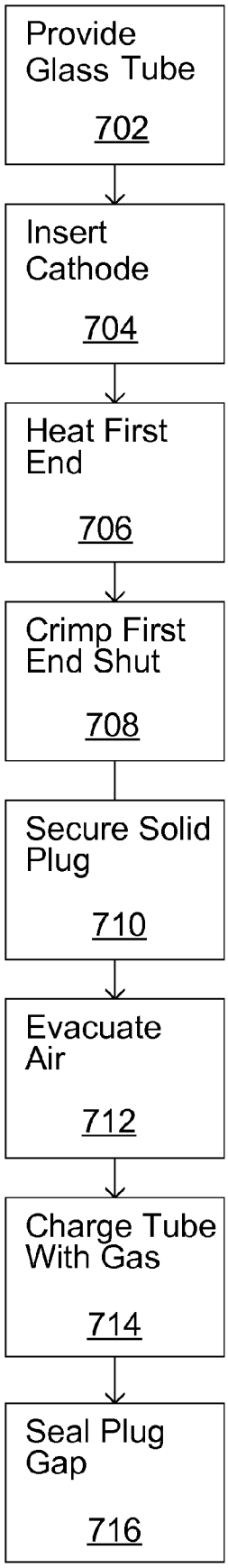
FIG. 7 is a process flow chart for making a GFE.

A flow chart of the method of making the GFE is shown in FIG. 7. First, a glass or quartz tube is provided 702. A cathode is inserted 704 into the first end. The first end is optionally heated 706 before crimping the first end shut 708, thereby securing the cathode and making the first end airtight.

A solid plug is installed and secured 710 inside the tube second end, but a gap is left between the plug and tube through which a gas can pass. The plug is anchored to the tube wall.

The air is evacuated 712 from inside the tube by connecting a vacuum means to the tube second end and drawing air through the second end past the plug. Then charge the tube 714 from the same opening with a desired gas or gases, letting the vacuum draw the gas inside. While the open second end is still under a gas charge, seal the plug gap 716 by heating the area around the plug.

Figure 8:
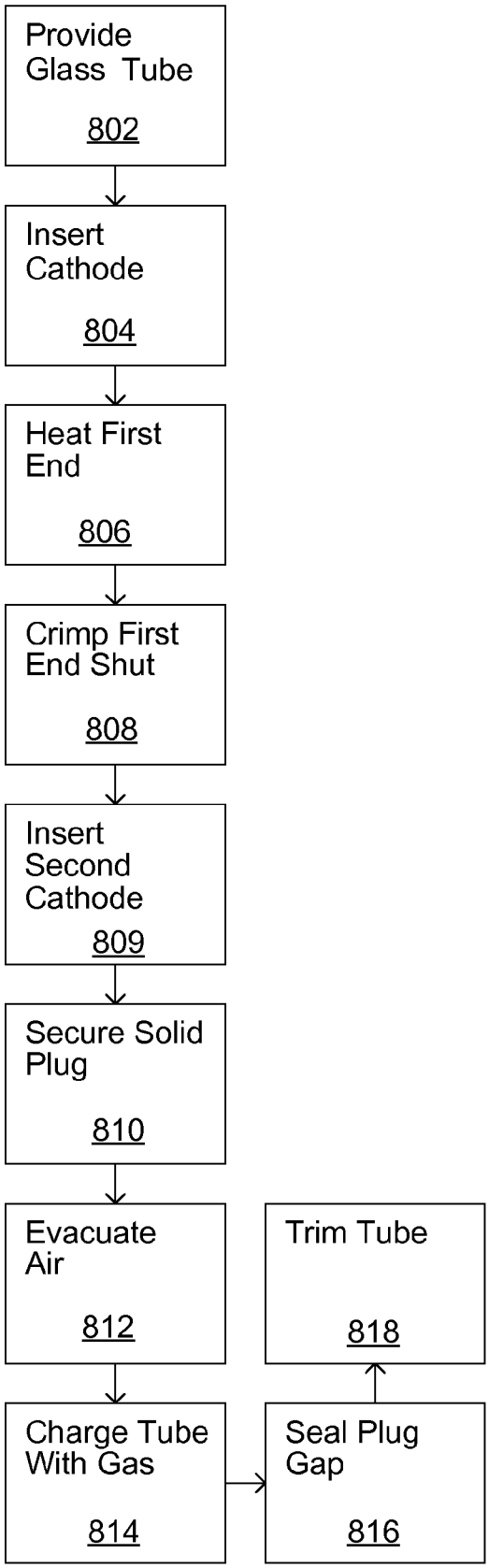
FIG. 8 is a process flow chart for making a tubulation-free lamp.

A flow chart of making the lamp is shown in FIG. 8. First, a glass or quartz tube is provided 802. A cathode is inserted 804 into the first end. The first end is optionally heated 806 before crimping the first end shut 808, thereby securing the cathode and making the first end airtight. A second cathode with second wire is inserted into the plug 809. Install plug 810 (with cathode and wire) at the second end of the tube. Evacuate air 812 and charge the tube with gas 814 as for the GFE. Seal plug to the wall by heating 816. Trim the tube length as required 818 to produce the desired end configuration (eliminating the non-conductive region described as part of the GFE design). The resulting assembly now resembles a typical gas-filled tubular lamp with an electrode at each end but with no tubulation.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A method of making a tubulation-free gas filled electrode comprising the steps of:

providing a glass or quartz tube having a first end and a second end opposite the first end;

inserting a cathode with a cathode lead wire into the first end;

crimping shut the first end, thereby securing the cathode lead wire and making the first end airtight;

securing a solid plug to at least a portion of an inner wall of the glass or quartz tube at the second end, but leaving a gap directly between the solid plug and the inner wall through which gas can pass;

evacuating air from inside the glass or quartz tube by drawing it through the second end past the plug;

charging the glass or quartz tube with a gas; and sealing the gap to make the second end airtight.

2. The method of claim 1, wherein before said crimping, the first end is softened by heating.

3. The method of claim 1, wherein securing the solid plug to at least a portion of an inner wall of the glass or quartz tube at the second end is performed by anchoring the plug to the inner wall by heating.

4. The method of claim 1, wherein sealing the gap is performed by heating the second end of the glass or quartz tube all around the solid plug.

5. A method of making a tubulation-free gas filled lamp comprising the steps of:

providing a glass or quartz tube having a first end and a second end opposite the first end;

inserting a first cathode into the first end;

crimping the first end thereby securing the first cathode and making the first end airtight;

inserting a second cathode through a hole in a solid plug so that it is airtight;

securing the solid plug to at least a portion of an inner wall of the glass or quartz tube at the second end, but leaving a gap directly between the solid plug and the inner wall through which gas can pass;

evacuating air from inside the glass or quartz tube by drawing it through the second end past the solid plug;

charging the glass or quartz tube with a gas; and sealing the gap to make the second end airtight.

6. The method of claim 5, wherein before said crimping, the first end is softened by heating.

7. The method of claim 5, wherein securing the solid plug to at least a portion of an inner wall of the glass or quartz tube at the second end is performed by heating.

8. The method of claim 5, wherein sealing the gap is performed by heating.

9. The method of claim 5, further comprising trimming the glass or quartz tube to produce a desired end configuration.

* * * * *